United States Patent [19]

McCormick et al.

[11] 4,343,131

[45] Aug. 10, 1982

[54] METHOD AND APPARATUS FOR PRODUCING BALES

[75] Inventors: Lloyd G. McCormick, Asheville; Robert E. Score, Arden, both of N.C.

[73] Assignee: EA Industries, Incorporated, Asheville, N.C.

[21] Appl. No.: 146,128

[22] Filed: May 2, 1980

[51] Int. Cl.[3] ..... B65B 13/20; B65B 63/02

[52] U.S. Cl. ..... 53/397; 53/438; 53/526; 53/529; 53/580; 100/3; 100/7

[58] Field of Search ..... 53/397, 436, 439, 176, 53/209, 526, 528, 530, 566, 580, 252, 449, 399, 438, 582, 529; 100/3, 7, 153, 218; 198/621, 744

[56] References Cited

U.S. PATENT DOCUMENTS

| | | | |
|---|---|---|---|
| 655,998 | 8/1900 | Taylor | 53/526 X |
| 1,560,373 | 11/1925 | Birnstock | 198/621 |
| 1,631,125 | 6/1927 | Happel | 198/744 X |
| 2,124,962 | 7/1938 | Ferguson et al. | 53/566 X |
| 2,215,545 | 9/1940 | Demler | 53/526 X |
| 2,668,614 | 2/1954 | Lawson | 198/744 X |
| 2,974,461 | 3/1961 | Demler | 53/209 X |
| 3,007,293 | 11/1961 | McGihon | 53/566 X |
| 3,370,549 | 2/1968 | Livingston | 53/529 X |
| 3,426,506 | 2/1969 | Jernigan | 53/566 |
| 3,445,983 | 5/1969 | Stevens | 53/209 X |
| 3,515,056 | 6/1970 | Johnson | 100/3 X |
| 3,760,554 | 9/1973 | Arneson | 53/209 X |
| 3,795,084 | 3/1974 | Richardson | 53/529 X |
| 3,824,758 | 7/1974 | Hart | 53/436 |
| 3,968,619 | 7/1976 | Fishburne | 53/399 |
| 3,977,155 | 8/1976 | Spaulding | 53/529 X |
| 4,067,172 | 1/1978 | Paules | 53/566 X |

*Primary Examiner*—John Sipos

*Attorney, Agent, or Firm*—William E. Mouzavires

[57] ABSTRACT

Method and apparatus for producing bales of tobacco compressed between opposed boards with strapping applied about the boards with predetermined tension. Tobacco is compressed in a chamber at the bottom of a charger and then ejected in one direction along a horizontal plane directly between a pair of opposed boards which are then moved with the tobacco therebetween at right angles to said one direction to the strapping station. The tobacco and boards are constrained during movement to the strapping station to control the dimension and shape of the bale prior to strapping which can then be applied with predetermined tension to maintain dimensional control over the bale.

25 Claims, 9 Drawing Figures

LS
SS
16
18
18a
19
20
20a
21
23
24
34
40
46
50
52
60
60a
64
66
110
122
130
140
142
2
3
4
5

METHOD AND APPARATUS FOR PRODUCING BALES

OBJECTS OF INVENTION

An object of the present invention is to provide a novel and improved method and apparatus for producing bales of loose compressible material such as tobacco packed between opposed boards with strapping applied about the boards with tension. While the invention is particularly suitable for producing bales of tobacco as aforesaid, it may have equal applicability to other loose, compressible, materials.

Another object of the present invention is to provide such method and apparatus as described above which will produce bales of predetermined size and shape with accuracy and dimensional control. Included herein is the provision of such method and apparatus which permit strapping to be applied to the bales under a predetermined tension to maintain the shape and integrity of the bale during subsequent handling.

A further object of the present invention is to provide such method and apparatus suitable for use in commercial mass production with conventional tobacco chargers and pressing equipment.

A further object of the present invention is to provide method and apparatus which eliminate some cumbersome or difficult steps heretofore utilized in practices of the prior art, while at the same time increasing the control over the size and shape of the bale. In particular, the present invention eliminates the need of compression sleeves heretofore employed for the purpose of containing the compressed tobacco subsequent to pressing and prior to entry between packing boards. Such sleeves, for example, are disclosed in U.S. Pat. No. 3,968,619 to Francis B. Fishburne. Additionally, the present invention eliminates the need of compacting the tobacco while contained within its packing members such as disclosed in U.S. Pat. No. 3,824,758 to Hart et al.

A further object of the present invention is to provide such method and apparatus that will not only accurately dimension and shape all sides of the bale but also that will smooth and polish exposed sides of the tobacco to improve the overall appearance of the bale.

SUMMARY OF INVENTION

Tobacco is packed in a compression chamber at the bottom of a typical charger and then a cake of tobacco is ejected from the compression chamber in a first horizontal direction directly between a pair of overlying horizontal packing members, preferably boards which are held stationary at this time. The boards with the cake of tobacco therebetween are then conveyed in a second horizontal direction at right angles to the first horizontal direction to a strapping station during which conveyance, the tobacco is given a chance to settle while the boards and the opposite sides of the cake are contained against movement to establish and maintain control over the dimensions and shape of the bale while at the same time polishing exposed sides of the tobacco to enhance the apperance of the bales. At the strapping station, a conventional strapper then applies straps about the boards with a predetermined tension.

The invention also resides in novel apparatus for handling the cake of tobacco and its packing members during conveyance to the strapping station.

DRAWINGS

Other objects and advantages of the present invention will become apparent from the following more detailed description taken in conjunction with the attached drawings in which.

DETAILED DESCRIPTION

The method and apparatus of the present invention will now be described in greater detail in connection with the attached drawings which show a preferred apparatus of the present invention for performing the method of the present invention.

METHOD

Figures 1, 3:
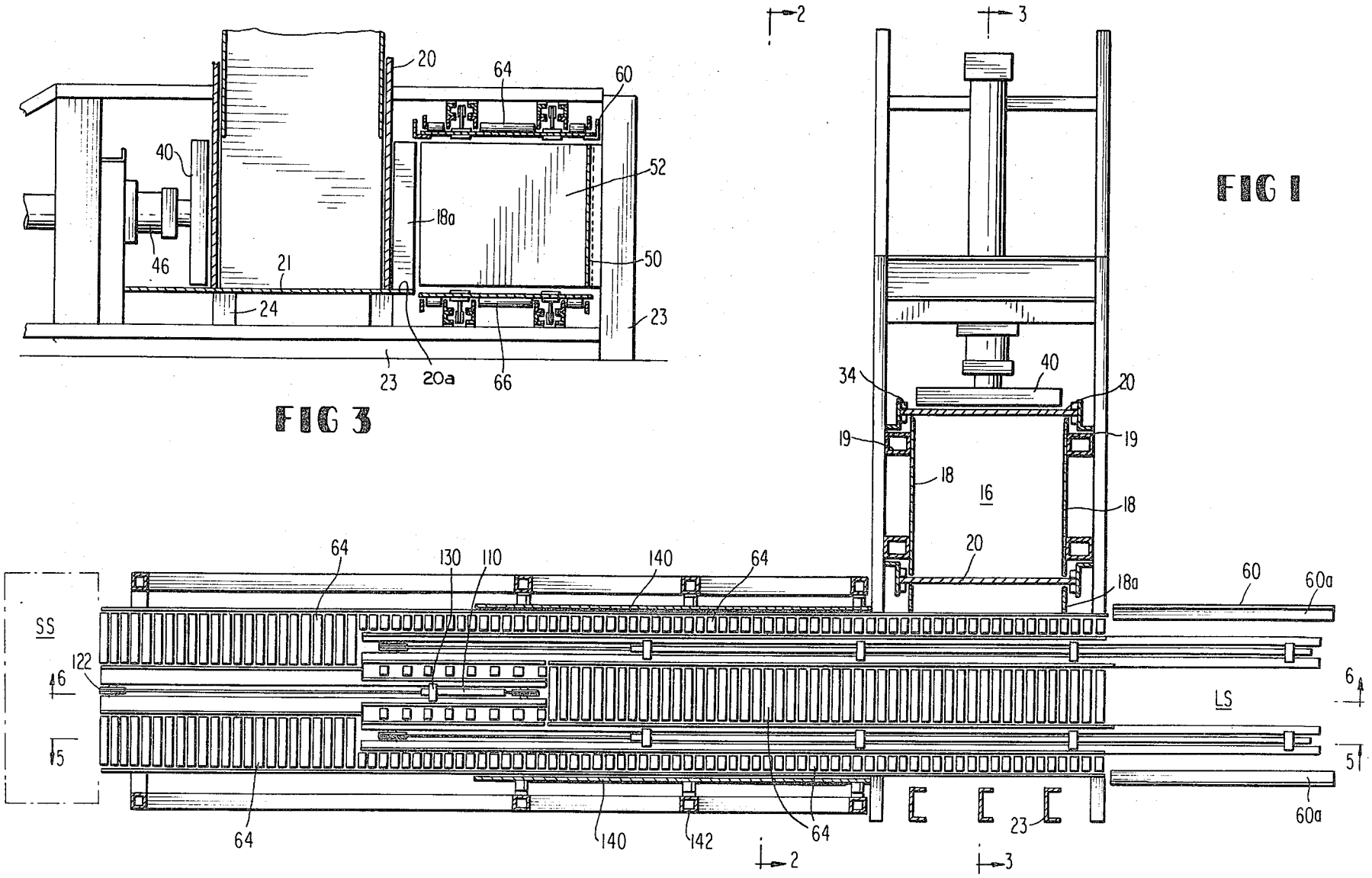
FIG. 1 is a plan view of apparatus constituting a preferred embodiment of the present invention for carrying out the method of the present invention, with certain parts of the apparatus removed for clarity.
FIG. 3 is a cross-sectional view taken generally along lines 3—3 of FIG. 1.
Figure 2:
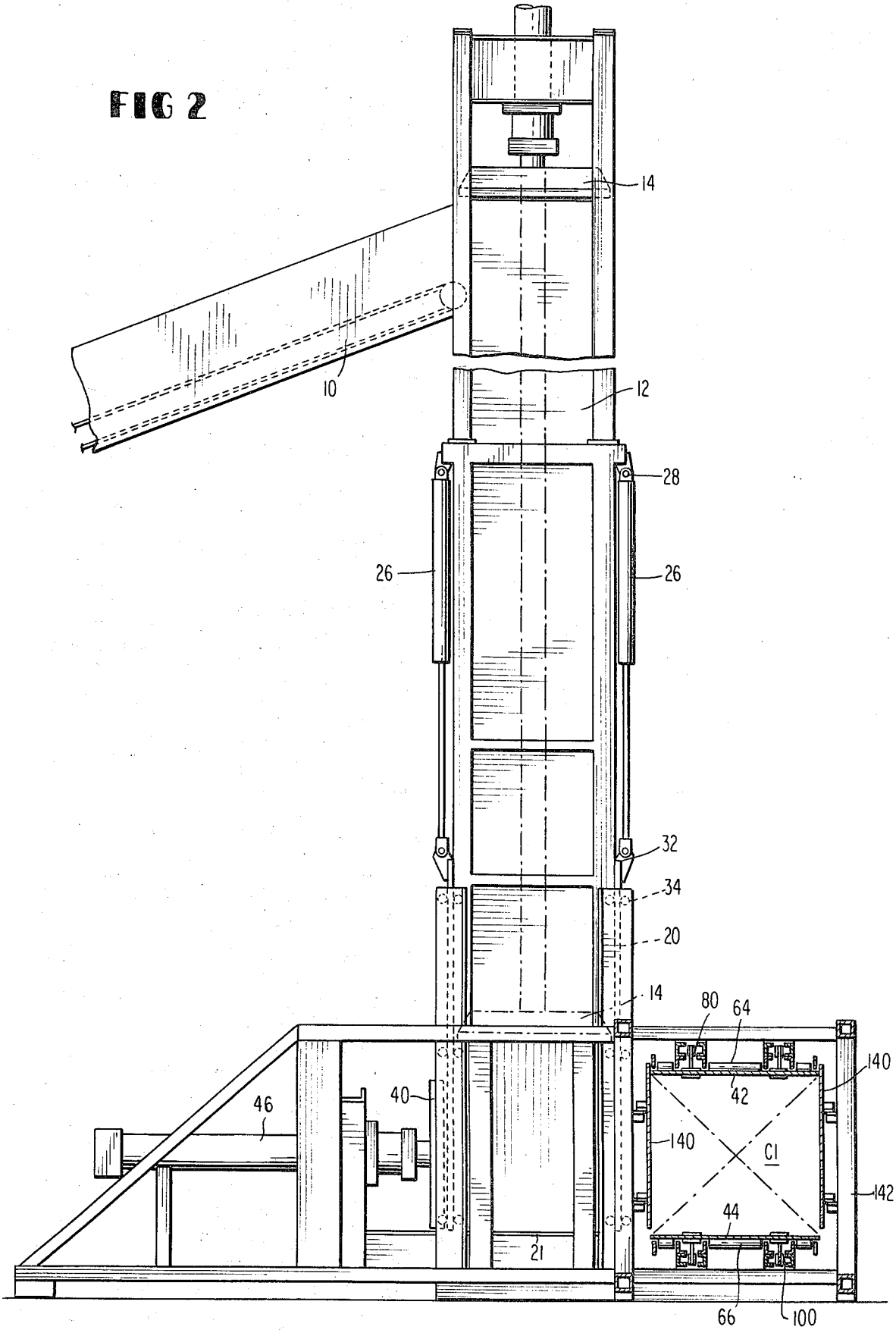
FIG. 2 is a cross-sectional view taken generally along lines 2—2 of FIG. 1.

Referring initially to FIGS. 1, 2 and 3, the basic method of the present invention will first be described. Loose compressible material such as tobacco is delivered by an in-feed conveyor 10 to a tobacco press including a charger 12 and a vertical plunger having a packing head 14. The aforementioned elements are, of course, well-known and conventional in the prior art. At the bottom of the charger is a compression chamber 16 (FIG. 1) into which the tobacco is compressed to a predetermined shape and dimension by means of packing head 14; preferably the tobacco is pressed to a dimension less than its ultimate dimension when baled. Compression chamber 16 is formed by opposite fixed side walls 18 and opposite end walls which are in the form of vertically movable doors 20; the compression chamber in the preferred embodiment shown having a rectangular shape. The bottom of the compression chamber is formed by a horizontal floor 21 supported on the main frame 22 by footings 24 as shown in FIG. 3. Any suitable reinforcement of the side walls 18 of the compression chamber may be provided such as the columns 19 best shown in FIG. 1.

Referring to FIG. 2, compression chamber doors 20 may be raised and lowered by any suitable means such as that shown which includes fluid motors which may be air cylinders or hydraulic cylinders 26 anchored at 28 to the main frame of the charger system and having vertical actuating rods 30 suitably connected at 32 to the upper ends of doors 20. Extension of actuating rods 30, of course, lowers the doors to close the opposite ends of compression chamber 16 while retraction of the actuating rods raises the doors to permit the compressed tobacco to be discharged from the compression chamber. Any suitable guide or track system for supporting and guiding the doors may be employed including rollers 34 mounted in the track system to be engageable with the opposite sides of each of the doors.

After the compressed tobacco which at this stage may be termed a "cake" is formed in the compression chamber 16, the doors 20 are raised and an ejector head 40 is driven in a first horizontal direction through the compression chamber to push the cake out of the chamber and directly between a pair of opposed upper and lower packing members 42, 44 which typically may be rectangular plywood boards corresponding in dimension to that of the cake. The ejector head 40 itself, of course, may be conventional as is its actuator 46 which may be any suitable fluid motor supported together with the ejector head on the basic frame structure 22. If desired, the tobacco may be guided during transit between compression chamber 16 and the packing members 42, 44 by transitional side walls **18*a* and bottom wall 20*a* as best shown in FIG. 3**.

Packing boards 42, 44 are held in spaced horizontal parallel planes adjacent the compression chamber 16 by a support and conveyor system to be described in more detail below. In the preferred embodiment, the position of the cake of tobacco within packing boards 42, 44 may be determined at one end by ejector head 40 and at an opposite end by a stop which may be a vertical wall or plate member 50 shown in FIG. 3. In addition, packing members 42, 44 are supported (in a manner to be described below) against movement away from each other under the pressure of the cake received therein. If desired, a guide plate 52 in the form of a vertical wall shown in FIGS. 3 and 4, may be provided to guide the cake during its movement from compression chamber 16 into the space between packing boards 42, 44.

After the tobacco cake is received between packing boards 42, 44, the latter are conveyed in a direction at right angles to the direction of movement of the ejector head 40 (the direction of movement of the tobacco cake when leaving the compression chamber) to eventually deposit the packed tobacco cake at a strapping station where straps are applied about the boards under predetermined tension to form the final bale. During the conveyance of the cake of tobacco between the boards to the strapping station, the boards 42, 44 are contained against movement away from each other under the pressure of the tobacco compressed therein. In addition, the opposite sides of the tobacco are dimensioned and shaped while contained against movement, by guide plates 140 which extend on opposite sides of the path of movement. The guide plates, which preferably have a smooth exceedingly low friction inner surface, also function to smooth and polish the tobacco to enhance the appearance thereof.

After a pair of boards have been packed with a cake, the unit is indexed towards the strapping station clearing the receiving station for receipt of another pair of boards for repeating the packing process.

The method of the present invention thus provides the direct insertion of compressed tobacco between the ultimate packing boards, thereby eliminating the need of an intermediate sleeve as heretofore employed in the prior art. At the same time, the present invention establishes and maintains control over the size and shape of all sides of the bale prior to strapping. In addition, during the time the bale is conveyed to the strapping station, the tobacco is given an opportunity to settle and then at the strapping station, the straps are applied with a predetermined amount of tension to maintain the desired shape and dimension of the bale. This eliminates the need of applying straps about the boards prior to the receipt of the tobacco within the boards as is done in the process disclosed in Fishburne U.S. Pat. No. 3,968,619 cited above. Because of the fact that the strapping in the Fishburne process is not effected under tension, it is difficult to achieve accurate control of the dimensions and shape of the bale. This problem, of course, is eliminated with the present invention. Furthermore, the present invention obviates the need of compacting with the plunger 14, the tobacco while it is contained by the packing boards as is done in the process disclosed in Hart et al U.S. Pat. No. 3,824,758 cited above.

APPARATUS

Figure 4:
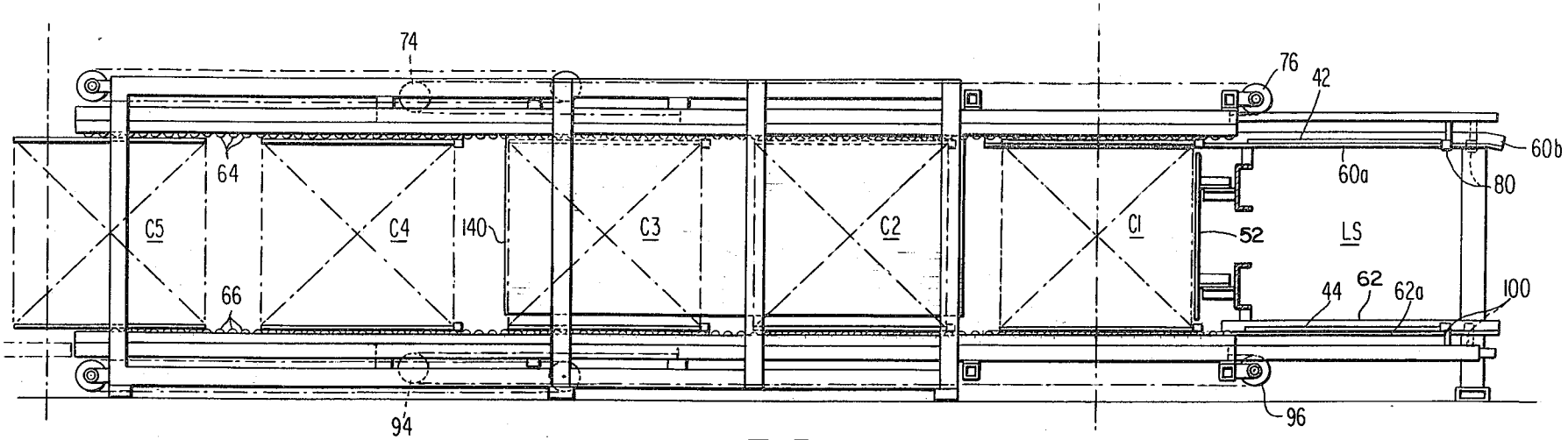
FIG. 4 is a side elevational view of the apparatus illustrating several cakes of tobacco held within packing members, during movement to a strapping station.
Figure 5:
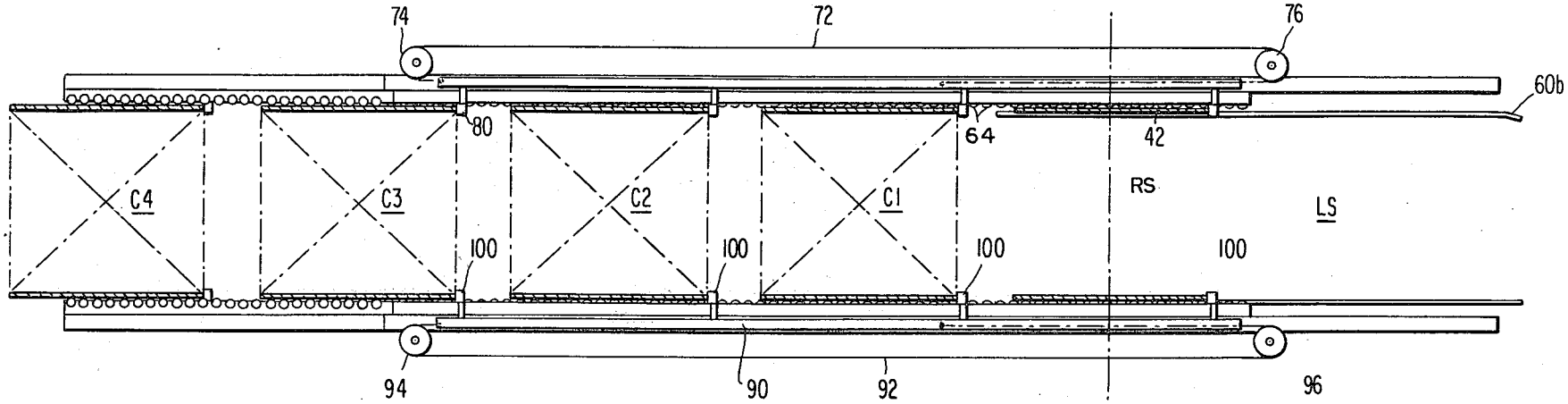
FIG. 5 is an elevational view generally similar to FIG. 4 but taken along lines 5—5 of FIG. 1 and also showing the cakes advanced one station from their positions of FIG. 4.

Further in accordance with the present invention, novel apparatus is provided for supporting the packing boards 42, 44 at the receiving station RS (FIG. 5) for receiving the cake of compressed tobacco and for conveying the packing boards with the cake therebetween to the strapping station generally indicated by SS in FIG. 1. In the preferred embodiment, the apparatus includes a pair of upper tracks in the form of channels 60 and a pair of lower tracks in the form of channel members 62 extending along parallel horizontal paths at right angles to the path of movement of the compressed tobacco when it leaves compression chamber 16. Channels 60, 62 are dimensioned and spaced from each other to receive the opposite sides of packing boards 42, 44 and to hold the packing boards in a predetermined vertically spaced interrelationship corresponding to the ultimate size of the bale to be formed. The upper packing board 42 rests on the horizontal flange **60*a* of upper channels 60, while the lower packing board 44 rests on the horizontal flange 62*a* of lower channels 62 as best shown in FIGS. 1 and 4. The right-hand ends of channels 60, 62 as viewed in FIG. 4 of the drawings are open so that the packing boards may be inserted into the channels through the open ends. As shown in FIGS. 4 and 5, the ends 60*b* of upper channels 60 are raked downwardly at an angle to facilitate insertion of the upper packing board therein. Insertion of the packing boards into the channels may be effected in any suitable manner including manual insertion by an operator removing the boards from a supply stack (not shown) adjacent to the apparatus and by placing them into the ends of channels 60, 62**.

Once the packing boards are initially inserted in the upper and lower channels 60, 62 at the loading station LS, they are conveyed to the receiving station RS adjacent to and in line with the path of movement of the tobacco cake leaving compression chamber 16 by meams of a conveyor system including upper and lower conveyors to be described below. When the cake is pushed between packing boards 42, 44, it is necessary to constrain the packing boards in the desired spaced apart horizontal positions in order to control the dimension and shape of the bale to be formed. This is achieved by a support system which, in the preferred embodiment, includes a plurality of sets of upper and lower rollers 64, 66 extending transversely of the axes of the upper and lower channels 60, 62 so as to be engageable with the upper surface of upper packing board 42 and the lower surface of lower packing board 44 to limit outward movement of the packing boards. Any suitable horizontal and vertical basic support frame structure may be provided such as shown for supporting channels 60, 62 and rollers 64, 66.

Additionally, in the preferred embodiment, the precise positioning of the compressed tobacco within the packing boards is achieved by a suitable stop preferably in the form of the vertical wall 50 (described above) fixed to vertical support columns 23 at the end of the path of movement of the tobacco when traveling between the packing boards as best shown in FIG. 3. It is noted that stop 50 has been omitted from FIG. 1 for clarity.

Furthermore, if desired, the movement of the tobacco from compression chamber 16 into the space between the boards 42, 44 may further be guided by the plate or vertical wall 52 which is shown in FIGS. 3 and 4 and has been described above. It will thus be seen that when doors 20 of compression chamber 16 are raised and ejector head 40 is driven through the compression chamber, a cake of tobacco will be forced between the boards 42, 44 and against stop 50. The stroke of ejector head 40 is designed accordingly so as to traverse the necessary distance to deposit the compressed tobacco within the boards in the manner aforesaid.

CONVEYOR SYSTEMS

Figure 7:
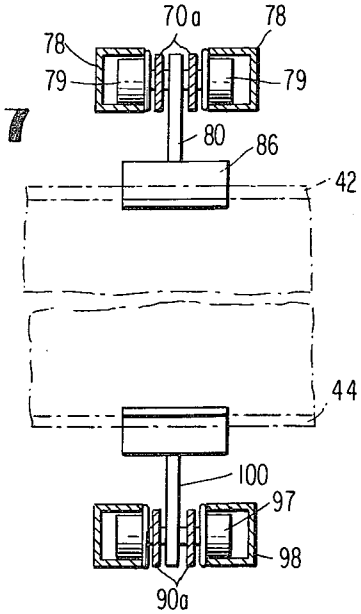
FIG. 7 is a fragmental, cross-sectional view showing upper and lower pusher members included in the aforedescribed apparatus for pushing packing members with tobacco cakes therebetween to a strapping station.

In the preferred embodiment, a pair of upper conveyors and a pair of lower conveyors are utilized to convey the packing boards 42, 44 along channels 60, 62 first from their loading station LS to the receiving station RS for receiving tobacco and subsequently to another conveyor system which takes the packed cakes to the strapping station SS. The conveyor in each pair are identical to each other. Each conveyor of the upper pair includes an elongated drive member generally designated 70 which may be termed a "pusher bar" driven from right to left as viewed in the drawings and then back from left to right by means of an endless drive member such as a chain 72 trained about end pulleys 74, 76 as best shown in FIG. 5; it being understood that pusher bar 70 is suitably connected to the endless drive chain 72 to be movable therewith. Any suitable motor (not shown) associated with one of the sprockets may be provided for driving the endless chain about sprockets 74, 76. Referring to FIG. 7, each pusher bar, in the preferred embodiment, is constructed from two elongated bars **70*a* fixed together and guided in their movement by a pair of tracks 78 shown as U-shaped channels receiving rollers 79 fixed to the pusher bar members 70*a***.

Figure 8B:
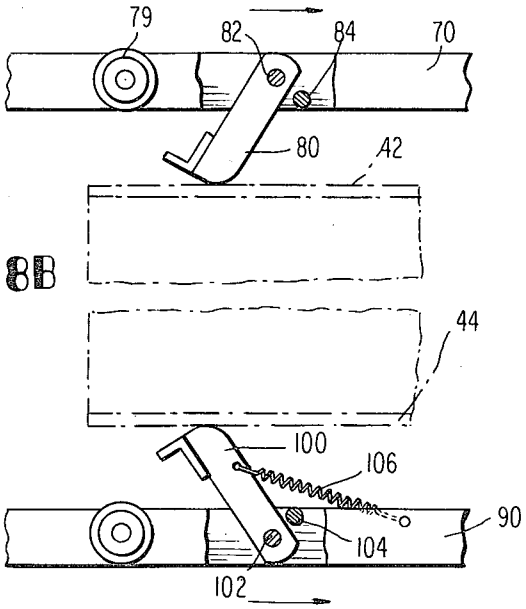
FIG. 8B is a view similar to FIG. 8A but showing the pusher members in their retracted, idle position.

Depending from pusher bar 70 at longitudinally spaced locations therealong are a plurality of pusher members generally designated 80 in the form of dogs pivotally mounted to the pusher bars for movement between an extended, operative position (FIGS. 7, 8A) for engaging the trailing ends of the upper packing boards 42 for moving them along channels 60 from right to left as viewed in the drawings; and a retracted position best shown in FIG. 8B for permitting the pusher bar 70 to return to the extreme right-hand position for loading a new packing board 42 in upper channel 60 as will be further described. In the preferred embodiment shown, there are four pusher members 80 for handling four successive packed cakes C1, C2, C3 and C4.

Figure 8A:
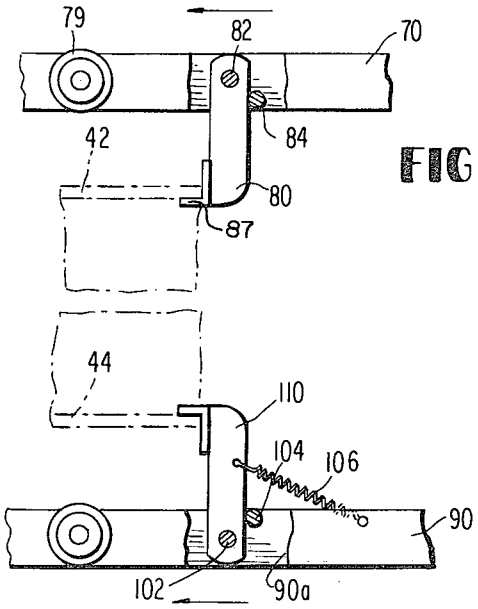
FIG. 8A is a side, elevational view of the pusher members shown in FIG. 7 when the pusher members are in their extended operative position.

Referring to FIGS. 7, 8A and 8B, upper pusher members 80 are pivotally mounted to pusher bars 70 between the members **70*a* by pivot pins 82; and a plurality of stops 84 are fixed on pusher bars 70 between members 70*a* adjacent the pusher members 80 respectively to engage the pusher members 80 and define their lowermost operative position as best shown in FIG. 8A. It will be seen that when the pusher bar 70 is moved to the left by drive chain 72, pusher members will engage the trailing ends of upper packing boards 42 to drive the packed cake of tobacco to the left. To facilitate engagement behind the trailing edge of the upper boards 42, the pusher members 80 are each provided with a transversely extending foot 86 (see FIG. 7) having a forwardly projecting flange 87 to be received under the board 42 as shown in FIG. 8A**.

Although stop 84 will maintain upper pusher members 80 in their extended positions when the pusher bar is moved to the left to advance the packed cakes towards the strapping stations, when the pusher bar is moved in the opposite direction for loading a new board 42, the pusher members 80 will pivot about pins 82 into retracted positions as shown in FIG. 8B to permit such movement of the pusher bar 70 to proceed.

Similar to the upper conveyors with their pusher bars 70 and pusher members 80, the pair of lower conveyors also includes pusher bars 90 and pusher members 100 which work in unison with their upper convenory counterparts. Referring to FIG. 5, each lower conveyor includes an endless drive chain 92 trained about end sprockets 94, 96 and suitably connected to pusher bar 90 to drive the same in a horizontal plane back and forth for advancing the cakes C1, C2, etc., towards the strapping station and for returing the pusher members to the loading station LS. Drive chain 92 is actuated through a motor (not shown) which drives one of the sprockets 94, 96 and in turn, the drive chain. Pusher bar 90 is constructed in two parts **90*a* similar to the upper pusher bars 70, 70*a* and is mounted by roller 97 in tracks 98 formed by channels as shown in FIG. 7**.

Lower pusher bars 90 are provided with a plurality (four) pusher members 100 which function similarly to upper pusher members 80 to engage the trailing end of the lower packing boards 44 to move them along their support channels 62. However, lower pusher members 100 extend upwardly from lower pusher bars 90 where they are pivotally mounted by pins 102 as best shown in FIG. 8A. In addition, the extended operative positions of the lower pusher members 100 are determined by a plurality of stops 104 fixed to the lower pusher bars adjacent the lower pusher members respectively to engage them and define their extended operative positions shown in FIG. 8A.

To maintain the lower pusher members 100 against their associated stops 104, a plurality of tension springs 106 are provided with one end anchored in the lower pusher bar 90 and the opposite end anchored in the associated pusher member 100 as shown in FIG. 8A. Although the tension springs 106 will maintain the lower pusher members in their extended operative positions for pushing the lower packing boards 44 along the channels, as illustrated in FIG. 8A, when the lower pusher members are reversed in direction for reloading a new packing board in the system, the tension springs 106 will allow the lower pusher members to pivot in a counterclockiwse direction as shown in FIG. 8B.

In order to permit loading of new packing boards 42, 44 into the channels 60, 62 at the right-hand ends of the channels at loading station LS, the endless drive trains 72, 92 and the upper and lower pusher bars 80, 100 are designed so as to place the upper and lower pushers 80, 100 in the phantom line positions shown at the right in FIG. 4 which is the extreme right-hand position of the pusher bars and their pusher members. This permits the endmost pusher members to clear the trailing ends of the upper and lower packing boards 42, 44 which have just been inserted in their channels 60, 62. Subsequently, actuation of the pusher bars 70, 90 to the left will cause their pusher members to engage the trailing edges of the newly loaded packing boards as illustrated by the pushers shown in solid lines at the right end of FIG. 4. In this position, a new cake of compressed tobacco may be inserted between the boards at the receiving station as shown by the cake C1 in FIG. 4 while the preceding cakes C2, C3, C4 are spaced in advanced positions along the path towards the strapping station. When the pusher members are again actuated to the left by their pusher bars, the cake C1 just packed within the boards 42, 44 will move to the next position down the path towards the strapping station while the boards which were initially supplied in FIG. 4 will be moved to the receiving station as best shown in FIG. 5. At this point, a new set of boards may be inserted at the loading station LS to repeat the process again.

THE SECOND CONVEYOR SYSTEM

In order to permit the strapping operation to proceed at a faster rate of speed relative to the operations described above, another separate conveyor system is utilized to take the packed cakes of tobacco from the conveyor system described above to the strapping station SS. Refering to FIGS. 1 and 6, this conveyor system includes upper and lower carriages 110, 112 suitably fixed to endless drive chains 114, 116 respectively to be driven along horizontal paths under the guidance of suitable tracks generally designated 118, 120. Drive chains 114, 116 are trained about suitable end sprockets 122, 124 driven by suitable motors (not shown). Upper carriage 110 is provided with a depending pusher member 130 which is similar in construction and operation to the upper pusher members 80 described above. Lower carriage 112 is provided with a single pusher 132 which is similar in construction and operation to the lower pusher members 100 described above. Note however, that in the present instance, only a single upper pusher 130 and a single lower pusher 132 positioned axially along the path of movement are utilized in the preferred embodiment.

Figure 6:
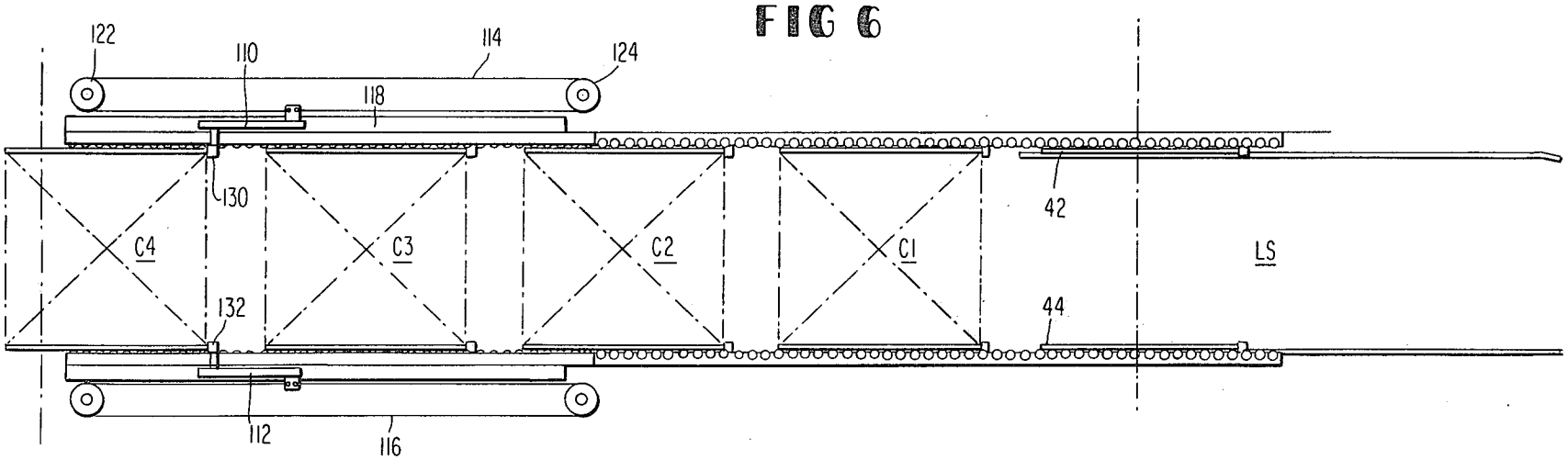
FIG. 6 is an elevational view generally similar to FIG. 5 but taken along lines 6—6 of FIG. 1.

When drive chains 114 and 116 are driven to the left as viewed in FIG. 6, the upper and lower pusher members 130, 132 will move with the drive chains to the left to cause the pusher members to engage the trailing ends of the packing boards 42, 44 to move the packed tobacco cakes to the strapping station SS where suitable strapping is applied in conventional fashion about the boards to hold them under a predetermined tension without loss or change in the shape and dimensions of the cake.

DIMENSIONING AND POLISHING GUIDES

In order to ensure that the shape and dimensioning of the tobacco cakes are maintained during movement from the receiving station RS towards the strapping station SS, the opposite sides of their path of movement along the first conveyor system are provided with suitable guide members in the form of stationary vertical plates or walls 140 best shown in FIG. 1. Guide walls 140 are suitably supported on vertical columns 142 of the basic frame support structure and are adjustable toward or away from each other to establish the desired dimension of the bale. Once adjusted, the guide walls 140 are fixed during operation.

Guide walls 140 need not extend the full distance to the strapping station, since by the time the cakes of tabacco reach the second conveyor system, the tobacco will have sufficiently settled into the desired dimension and configuration. It is for this reason that, in the preferred embodiment shown and described, the tobacco cakes are indexed through several positions before reaching the strapping station. However, the support rollers 64, 66 which constrain the packing boards 42, 44 extend throughout the path to the strapping station SS to ensure control over the size and shape of the cakes and the ultimate bales.

Guide walls also function to smooth and polish the tobacco to enhance the appearance of the bale. Preferably in this regard, the inner surface of the guide walls is formed with a smooth surface material having an exceedingly low coefficient of friction such as a ultra-high molecular weight material, one such commercial material being marketed under the trademark, ULTRA-CLAD. Such material also desirably reduces the heat transmitted to the tobacco.

What is claimed is:

1. A method of producing bales of loose compressible material such as tobacco, the steps comprising, compressing the material in a compression chamber, conveying individual upper and lower packing members for each bale having generally planar inside surfaces along upper and lower spaced generally horizontal and parallel paths to a compressed material receiving station, pushing the compressed material out of the chamber along a first path and directly to and between said opposed packing members and into direct engagement therewith at said receiving station, holding said members stationary and supporting them against movement away from each other under the pressure of the compressed material engaging the packing members, conveying the packing members with the compressed material therebetween to a strapping station while maintaining the support of the packing members to prevent movement away from each other, and then strapping the packing members with the material therebetween to a predetermined tension to form a bale, and wherein the method further includes the step of pushing the material against a stop surface after leaving the compression chamber and arriving between the packing members.

2. The method defined in claim 1 wherein the material with the packing members move to the strapping station along a second path generally at right angles to the first path so as to reorient the sides of the material relative to the path of movement, and wherein there is further included the steps of dimensioning and polishing the opposite sides of the material as it moves along the second path.

3. The method defined in claim 1 further including the step of containing the opposite sides of the material as it moves towards the strapping station to establish and maintain the dimension across the opposite sides of the material.

4. The method defined in claim 3 wherein said step of containing the opposite sides of the material includes the step of polishing the opposite sides of the material as it moves towards the strapping station.

5. A method of producing bales of loose compressible material such as tobacco, the steps comprising, compressing the material in a compression chamber, conveying individual upper and lower packing members for each bale having generally planar inside surfaces along upper and lower spaced generally horizontal and parallel paths to a compressed material receiving station, pushing the compressed material out of the chamber and directly to and between said opposed packing members and into direct engagement therewith at said receiving station, holding said members stationary and supporting them against movement away from each other under the pressure of the compressed material engaging the packing members, conveying the packing members with the compressed material therebetween to a strapping station while maintaining the support of the packing members to prevent movement away from each other, and strapping the packing members with the material therebetween to a predetermined tension to form a bale, and wherein the compressed material with the packing members moves to the strapping station generally at right angles to the direction of movement of the material when it leaves the compression chamber and enters between the packing members, and wherein there is further included the step of containing the opposite sides of the material as it moves to the strapping station, and wherein there is further included the step of packing the material against a stop after leaving the compression chamber and arriving between the packing members.

6. The method defined in claim 5 further including the step of engaging the exposed sides of the compressed material to guide the same as it moves between the packing members from the compression chamber.

7. Apparatus for producing bales of loose compressible material such as tobacco, the apparatus comprising in combination, a compression station for compressing said material, conveyor means for conveying individual upper and lower packing members having generally planar inside surfaces along upper and lower spaced generally horizontal and parallel paths to a first station for receiving the material in compressed condition and thereafter to a second station along the paths for delivering the material with the packing members to a strapping station, means for inserting said compressed material between said packing members in direct engagement therewith, support means for limiting movement of the packing members in a direction away from each other under the pressure of the material, guide means along opposite sides of the path for guiding and containing the materials during movement between said first and second stations, and stop means positioned on one side of and between the paths at said first station for engaging the material when received between the packing members at said first station.

8. Apparatus defined in claim 7 wherein said conveyor means includes upper and lower pusher members movable along said paths respectively for engaging the packing members to push them along said paths, and drive means for driving the pusher members along said paths.

9. Apparatus defined in claim 8 wherein said drive means is reciprocable along said paths between said stations.

10. Apparatus defined in claim 9 wherein said pusher members are each mounted relative to said drive means for movement between an extended operative position for engaging and pushing a packing member and a retracted idle position permitting return of the pusher members along said paths to said first station.

11. Apparatus defined in claim 10 wherein said drive means includes upper and lower drive members rectilinearly movable between said first and second positions and wherein said upper and lower pusher members are respectively pivotally mounted to said upper and lower drive members at longitudinally spaced locations therealong.

12. Apparatus defined in claim 11 wherein said upper and lower drive members have stops engageable with associated pusher members for defining the extended positions of the pusher members.

13. Apparatus defined in claim 12 wherein there is included spring means biasing said lower pusher members against their associated stops.

14. Apparatus defined in claim 7 wherein said conveyor means includes channels defining said upper and lower paths and dimensioned to receive and support packing members for movement along said paths between said first and second stations.

15. Apparatus defined in claim 14 wherein said channels are open at one of their ends for loading packing members thereof.

16. Apparatus defined in claim 14 further including guide means including plate-like members fixed along opposite sides of said paths for containing the material during movement from said first station to said second station.

17. Apparatus defined in claim 15 wherein said support means includes upper and lower rollers spaced along and extending in a direction across said paths for engaging the packing members to limit movement of the packing members away from each other under the pressure of material packed therebetween.

18. Apparatus defined in claim 7 wherein said guide means includes substantially flat inner surfaces positioned on opposite sides of said paths for engaging the opposite sides of the material to establish and maintain the dimension thereof between said surfaces.

19. Apparatus defined in claim 18 wherein said inner surfaces of said guide means have a low coefficient of friction to reduce heat and friction and to also polish the material as it moves through and between said surfaces.

20. Apparatus defined in claim 19 wherein said surfaces of the guide means are made from ultra-high molecular weight material.

21. Apparatus defined in claim 18 further including guide means positioned between said compression chamber and said first station for guiding the cake as it moves from said compression chamber to said first station between the packing members.

22. Apparatus defined in claim 18 wherein said stop means includes a substantially flat inner surface engageable with the material at said first station, and wherein said flat inner surfaces of said stop means and of said guide means are dimensioned to engage substantially the entire side of the material.

23. Apparatus for producing bales of compressible material such as tobacco, comprising in combination, a compression chamber including opposite side walls and opposite vertically movable doors forming end walls, a vertically movable plunger including a pressing head for packing in said compression chamber loose compressible material into a cake, an ejector head movable generally in a horizontal plane through said compression chamber when the doors are raised for ejecting a cake of compressed material from one end of the compression chamber, conveyor means for conveying individual upper and lower packing members for each bale having a generally planar inside surfaces along upper and lower spaced generally horizontal and parallel paths to a first station in line with and adjacent to said compression chamber means for holding upper and lower board-like packing members at said first station for receiving said cake in contacting engagement with and in between said members directly from said one end of the compression chamber when ejected by said ejector head, stop means at said first station for engaging and defining the position of the cake between said packing members at said first station, said conveyor means comprises means for moving said packing members with a cake therebetween towards a strapping station along a second generally horizontal path extending generally at right angles to the path of movement of said ejector head, means for constraining the packing members against movement under the pressure of the cake during movement towards the strapping station, and means positioned on opposite sides of said path for constraining the cake during movement towards the strapping station.

24. Apparatus defined in claim 23 further including guide means positioned between said compression chamber and said first station for guiding the cake as it moves from said compression chamber to said first station between the packing members.

25. Apparatus defined in claim 23 wherein said stop means and said means positioned on opposite sides of said path include flat inner surfaces dimensioned to engage substantially the entire side of the cake.

* * * * *